United States Patent [19]

Schierling et al.

[11] Patent Number: 4,976,246

[45] Date of Patent: Dec. 11, 1990

[54] FUEL-INJECTION PUMP ARRANGEMENT FOR A TWO-STROKE ENGINE OF A HANDHELD PORTABLE TOOL

[75] Inventors: Roland Schierling, Affalterbach; Michael Wissmann, Schorndorf-Weiler; Hans Nickel, Cottenweiler; Werner Geyer, Waiblingen, all of Fed. Rep. of Germany

[73] Assignee: Andreas Stihl, Waiblingen, Fed. Rep. of Germany

[21] Appl. No.: 262,146

[22] Filed: Oct. 21, 1988

[30] Foreign Application Priority Data

Oct. 22, 1987 [DE] Fed. Rep. of Germany ..... 3735711

[51] Int. Cl.[5] ..... F02M 39/00; B27B 17/02

[52] U.S. Cl. ..... 123/509; 123/73 AD; 123/41.31; 30/381

[58] Field of Search ..... 123/509, 41.31, 73 AD, 123/73 A, 73 B, 73 C, 495; 30/381, 382, 383

[56] References Cited

U.S. PATENT DOCUMENTS

| | | | |
|---|---|---|---|
| 3,525,373 | 8/1970 | Kobayashi | 30/381 |
| 3,530,909 | 9/1970 | Scharpf | 30/381 |
| 3,542,095 | 11/1970 | Frederickson | 30/381 |
| 4,551,076 | 11/1985 | DuBois | 123/73 AD |
| 4,594,971 | 6/1986 | Borst | 123/73 AD |
| 4,602,656 | 7/1986 | Nagashima | 30/381 |
| 4,607,598 | 8/1986 | Kamata | 123/73 AD |
| 4,700,668 | 10/1987 | Schierling | 123/73 C |
| 4,785,539 | 11/1988 | Nagashima | 30/381 |
| 4,813,391 | 3/1989 | Geyer | 123/73 AD |
| 4,835,866 | 6/1989 | Nagashima | 123/73 AD |

FOREIGN PATENT DOCUMENTS

| | | | |
|---|---|---|---|
| 214089 | 12/1984 | United Kingdom | 123/509 |

*Primary Examiner*—Carl Stuart Miller

*Attorney, Agent, or Firm*—Walter Ottesen

[57] ABSTRACT

The invention relates to a handheld portable tool driven by a two-stroke engine equipped with a pneumatically actuated injection pump. Injection pumps for two-stroke engines are generally rigidly connected to the engine so that the injection line can be rigid and as short as possible. This, however, leads to operational disturbances in the injection pump. To eliminate these disturbances, the injection pump is mounted in a thermally insulated handle housing portion of the tool which is damped with respect to the vibrations of the engine and is connected to the latter via flexible connecting lines.

9 Claims, 2 Drawing Sheets

5
34
35
36
10
28
24
26
27
20
37
30
31a
43
23
32
21
29
12
31b
25
38
39
33
40
22

A
10
5
9
11
37
43
33
12
15
A

FUEL-INJECTION PUMP ARRANGEMENT FOR A TWO-STROKE ENGINE OF A HANDHELD PORTABLE TOOL

FIELD OF THE INVENTION

The invention relates to a portable handheld tool driven by a two-stroke engine such as a chain saw. The tool includes a pneumatically-driven injection pump for injecting fuel into the engine and an intake pipe for the combustion air. The housing which includes the handle for carrying and guiding the tool is insulated with respect to vibration from the engine.

BACKGROUND OF THE INVENTION

U.S. Pat. No. 4,700,668 discloses a chain saw driven by a two-stroke engine having a pneumatically-actuated injection pump. The pneumatic drive chamber of the injection pump is partitioned by a membrane into a pulse chamber and a return chamber. The pulse chamber is charged directly with the crankcase pressure while the return chamber communicates with the atmosphere. The crankcase pressure alternates with the upward and downward movement of the piston and thereby moves the membrane up and down which, in turn, moves a pump piston attached to the membrane. The pump piston is guided in a pump cylinder and delimits a pumping chamber. The pump piston moves into the pumping chamber and pumps fuel via an outlet valve configured as a check valve. With the subsequent return movement of the pump piston, the check valve closes and an intake valve admits fuel into the pumping chamber for the next injection cycle. The intake valve opens in the direction of the pumping chamber and is configured as a check valve.

Such injection pumps are attached to the two-stroke engine itself in order that the injection lines be rigid and be as short as possible so that a precisely timed ignition is assured.

During operation, the two-stroke engine becomes hot especially in the region of the cylinder but also at the crankcase. All components mounted on the cylinder and the crankcase including the flange-connected injection pump are heated in this manner. In the hot injection pump, the fuel conducted therethrough and its easily boilable components tend toward evaporation because of the heat and vapor bubbles are formed. These vapor bubbles disturb the correct metering of fuel because the injection pump can only pump a defined volume in view of the way it has been constructed. The appropriate quantity of fuel does not reach the injection valve if a vapor bubble is drawn in and pumped to the injection valve. Large vapor bubbles cause the engine to die.

To provide an undisturbed operation of the fuel injection engine, the injection pump must therefore be thermally insulated in order to avoid the injection pump from becoming hot. However, insulating material between the engine and the injection pump would take up too much building space in order to be adequate.

In addition, the considerable vibrations of the two-stroke engine lead to operational disturbances in the injection pump and especially with respect to its check valves.

SUMMARY OF THE INVENTION

It is an object of the invention to reduce the frequency of failure of a pneumatically-actuated fuel-injection pump on a two-stroke engine in a portable handheld tool. It is a further object of the invention to reduce the frequency of failure with respect to the formation of vapor bubbles and vibration.

The invention is directed to a handheld portable tool such as a chain saw. The portable tool includes: a handle housing for holding and guiding the tool; a two-stroke engine having an air-intake pipe for conducting combustion air into the engine; vibration damping means disposed between the engine and the housing to reduce the vibrations transmitted from the engine to the housing; a pneumatically-driven fuel-injection pump for pumping fuel for the engine, the pump being mounted on the housing so as to be separated from the engine by the vibration damping means; and, yieldable connection means for interconnecting the pump and the engine.

The arrangement of the injection pump separate from the engine in the vibration-dampened handle housing of the tool substantially separates the engine vibrations from the injection pump. Furthermore, this arrangement assures that a transfer of heat from the two-stroke engine to the injection pump is prevented because of the separated arrangement of the two-stroke engine in the handle housing. The formation of vapor bubbles is in this way substantially precluded. This measure markedly increases the operational reliability of the pneumatic injection pump.

The arrangement of the injection pump in the vibration-dampened handle housing is opposed by the requirement of providing rigid, short injection lines. For a direct injection of fuel, the delay between the pumping of the fuel by means of the injection pump and the injection of the fuel into the combustion chamber must be held to a short duration. This is possible only with short, pressure-stiff injection lines. However, it has been surprisingly shown that even for two-stroke engines having direct injection, injection lines can be used which are flexible and yet are stable with respect to form and which permit a vibration decoupling of the injection pump from the two-stroke engine whereby an arrangement of the injection pump in the vibration-dampened handle housing is possible. The precisely timed injection even directly into the combustion chamber of the two-stroke engine continues to be assured with vibration-dampened injection lines which are stable as to their form.

Pursuant to a further embodiment of the invention, a segment of the intake pipe is integrated into the housing of the injection pump whereby the cold combustion air drawn in by suction effects a cooling of the pump housing which precludes a formation of vapor bubbles even under unfavorable external operating conditions. Preferably, the air-intake pipe segment lies next to the pumping chamber of the injection pump.

The intake pipe section which is integrated into the pump housing of the injection pump is preferably the throttle-flap stub so that the throttle flap shaft can be rotatably journalled in the housing of the injection pump. In this way, the possibility is provided to arrange the injection pump in the handle housing in lieu of the carburetor without difficulties resulting with respect to adequate space. To save space, it is advantageous to integrate a fuel feed pump into the housing of the injection pump which is likewise driven by the changing crankcase pressure.

The injection pump is preferably mounted next to the rearward handle of the handle housing so that the throttle linkage can be kept short. Displacing and adjusting arrangements provided on the injection pump are easily reachable in this way.

As an injection line, it has been shown advantageous to produce the line from a plastic having a polyamide base with the line being stable as to its form but yet being soft. It could not have been expected that, for a direct injection into the combustion chamber of a two-stroke engine, a form stable but yet soft plastic would withstand the pressure loads in such a manner that a substantially precisely timed injection without an expansion of the injection line is possible. The injection line itself is matched in its length, diameter and stiffness with respect to the external conditions such as velocity of the pump piston, injection pressure and the form of the injection nozzle.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
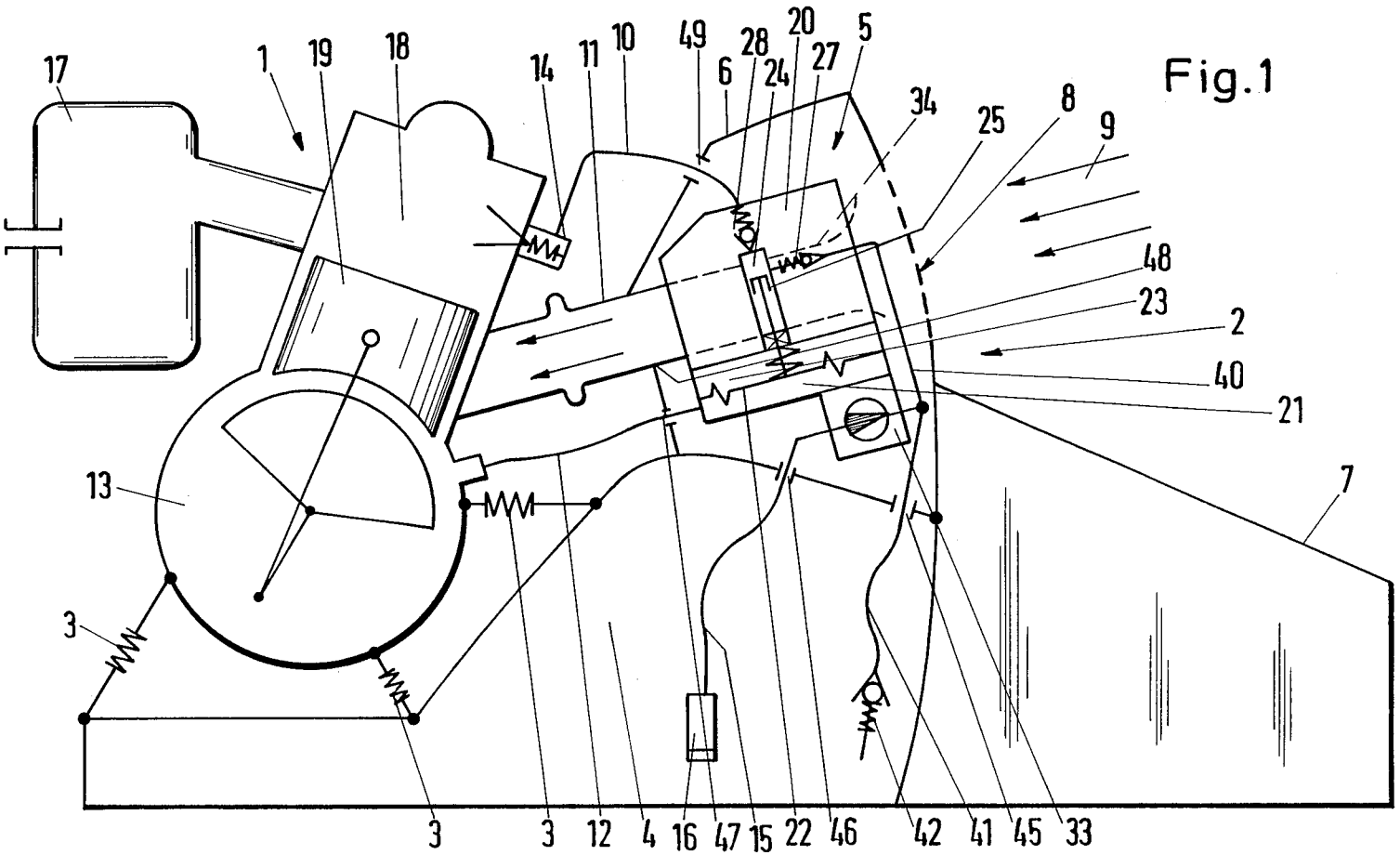
FIG. 1 is a schematic section taken through a hand-held portable tool which in this figure is a motor-driven chain saw.

The handheld portable tool in the form of a chain saw shown in FIG. 1 includes a two-stroke engine 1 and a guide bar (not shown) connected thereto as well as a handle housing 2 with handles for holding and guiding the chain saw. The engine 1 is covered by a housing (not shown) of the chain saw.

The handle housing 2 is connected via vibration absorbers 3 with the housing of the two-stroke engine 1 which is isolated with respect to vibration. A fuel tank 4 is formed in the handle housing 2 which is followed by the rear handle 7. A handle housing portion 6 is provided directly above the fuel tank 4 and adjacent the rear handle 7. The fuel injection pump 5 is mounted in this housing portion 6.

Figure 3:
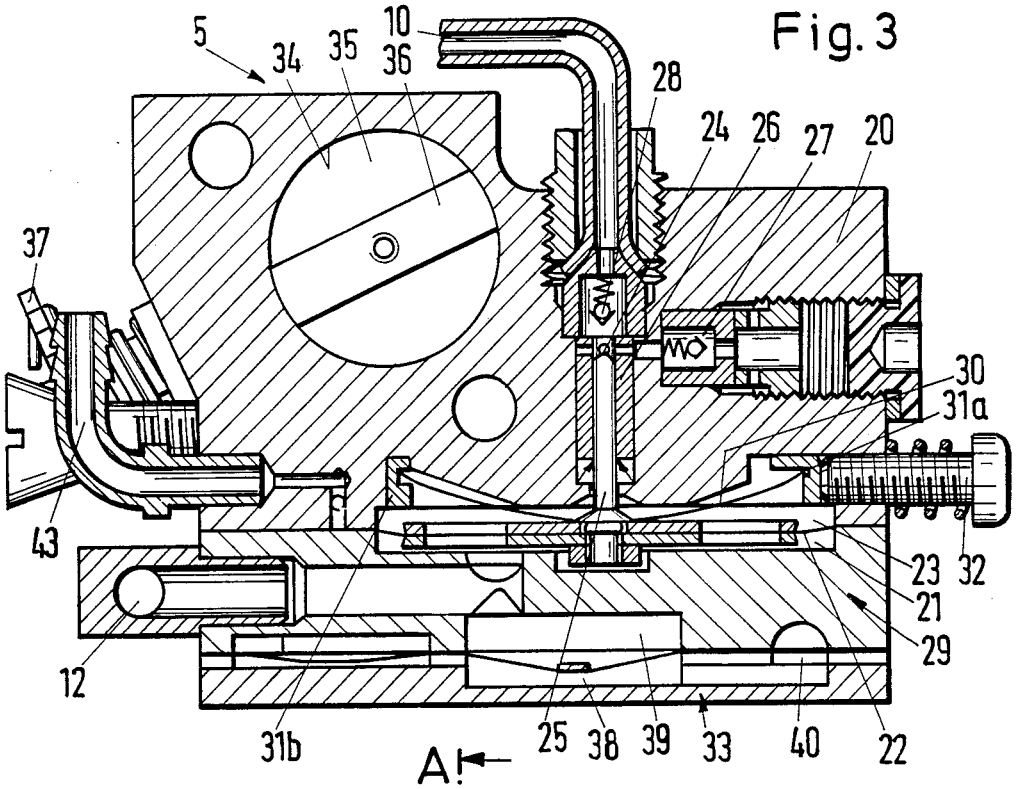
Figure 2:
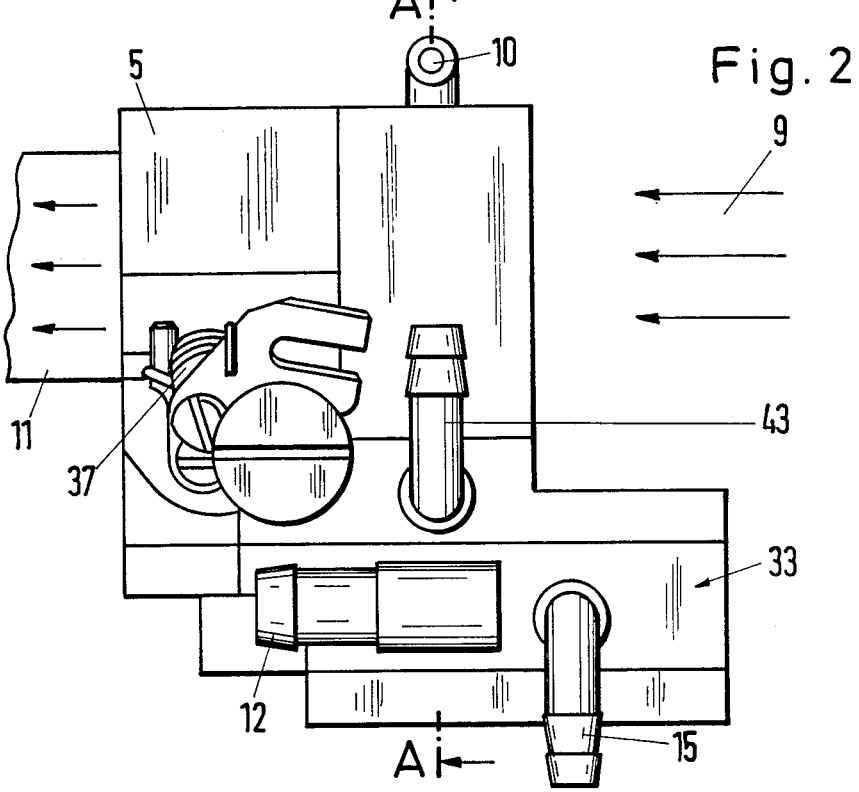
FIG. 2 is a side elevation view, in section, of an injection pump mounted in the handle housing of the portable tool of FIG. 1; and, FIG. 3 is a section view taken along line A—A of the injection pump of FIG. 2.

The injection pump 5 shown in FIGS. 2 and 3 includes a housing block 20 in which are integrated the following: the pneumatic drive chamber 29 of the injection pump 5; a pump cylinder 26; a pump piston 25; a pump chamber 24; an intake valve 27 open toward the pump chamber 24 which is configured as a check valve; an outlet valve 28 configured as a check valve which opens from the pump chamber 24 in the direction of flow to the injection line 10; and, a fuel feed pump 33.

In addition, and as shown in FIG. 3, a throttle flap support 34 of the intake channel is built into the housing 20 of the injection pump 5. The throttle flap 35 mounted in the throttle flap support 34 is journalled by means of a shaft 36 in the housing of the injection pump 5. The adjusting arrangement 37 acts on the shaft 37 for adjusting the throttle flap 35. The adjusting arrangement 37 is provided on the side of the housing of the injection pump as shown in FIG. 2. The throttle flap support 34 is perpendicular to the section plane A—A in FIG. 2 and is open at both of its ends.

The pneumatic drive chamber 29 of the injection pump 5 is partitioned by membrane 22 into a pulse chamber 21 and a return chamber 23. The pulse chamber 21 is connected to the crankcase 13 of the two-stroke engine 1 by a flexible pulse line 12. The changing pressures developed in the crankcase 13 by the upward and downward movements of the piston 19 act on the membrane 22. When the pressure increases, the pump piston 25 is moved into the pump cylinder 26 so that fuel disposed in the pump chamber 24 is delivered into the injection line 10 via the opening outlet valve 28 and is injected into the combustion chamber 18 of the engine 1 via the injection valve 14. When the pressure drops, the membrane 22 is returned to its initial position by the action of a leaf spring 30 mounted in the return chamber 23 while the intake valve 27 opens and fuel is replenished in the pump chamber 24.

The intake valve 27 is mounted in the pressure line 40 of the fuel feed pump 33. The pressure line 40 is integrated into the housing 20 of the injection pump 5. The fuel feed pump 33 is integrated into the housing 20 of the injection pump 5 and is likewise driven by the changing crankcase pressure. The fuel feed pump 33 essentially comprises a chamber which is partitioned by a membrane into a pumping chamber 38 and a pressure chamber 39. The pumping chamber 38 is connected with the suction line 15 to the tank 4 via a check valve (not shown); whereas, the pressure chamber is charged via pulse line 12 with the changing crankcase pressure. The feed and discharge channels of the fuel feed pump are preferably integrated into the housing 20 of the injection pump 5.

During operation, the fuel feed pump 33 draws in fuel from the fuel tank 4 via the feed line 15 and the suction snorkel 16 and pumps this fuel up to the inlet valve 27. A return line 41 is provided with a throttle or pressure-holding valve 42. Via this return line 41, the feed pressure in the pressure line 40 is so adjusted that the intake valve 27 is almost ready to open and the pumped fuel is pumped back into the tank via the return line 41. Only with the suction stroke of the pump piston 25 does the intake valve 27 open because of the underpressure developed in the pump chamber 24 and the fuel which is under the feed pressure flows into the pump chamber. The return line 41 is connected to the return connection 43 of the injection pump 5.

The precise operation of the injection pump is described in detail in U.S. Pat. No. 4,700,668 incorporated herein by reference.

The leaf spring 30 is held at its foot points in bearings (31*a*, 31*b*) so that these foot points do not work their way into the housing of the injection pump which is preferably made of aluminum or plastic. The bearing 31*a* is displaceable in the housing of the injection pump 5 in the longitudinal direction of the leaf spring 30 for adjusting the spring pretension. The adjustment is made by means of an adjusting screw 32. This adjustment assures that the quantity pumped by the injection pump is simply and precisely adapted to the crankcase pressure which is present.

The injection pump 5 is mounted in housing portion 6 closed on all sides and is connected to the two-stroke engine 1 via flexible connecting lines with the connecting lines being led through the wall of the housing portion 6 by appropriately configured pass-through openings which are preferably sealed.

Accordingly, the common wall between the housing portion 6 and the fuel tank 4 has two pass-through openings 45 and 46 through which the suction line 13 and the return line 41 extend in a seal-tight manner.

The wall partitioning the injection pump 5 with respect to the two-cycle engine 1 includes a pass-through opening 47 for the flexible pulse line 12 and a pass-through opening 48 for the flexible intake pipe between the throttle flap support 34 and the engine 1 as well as a pass-through opening 49 for the flexible injection line 10 made of form-stable plastic.

Since all connections between the injection pump 5 and the two-stroke engine 1 are flexible, vibrations of the engine are hardly transmitted to the injection pump at all. The housing wall and the air gap between the injection pump and the engine provide heat insulation. The open end of the throttle flap support 34 is configured as an intake funnel and lies opposite an intake opening 8 in the handle housing portion 6. This intake opening is preferably provided with a screen for holding back coarse dirt particles.

During operation of the two-stroke engine, the throttle flap 35 is adjusted by means of a throttle lever mounted in the handle 7 and the throttle flap is opened. The intake air 9 flows into the throttle flap support 34 via the intake opening 8 provided in the housing portion 6. In this way, the intake air 9 flows into the housing 20 of the injection pump 5 and cools the latter thereby. The throttle flap support 34 preferably lies next to the pump chamber 24 so that the latter is specifically cooled by the intake air 9. After leaving the housing 20, the intake air 9 is directed via the intake channel connection 11 into the crankcase of the engine and its overflow channels. The changing crankcase pressure drives the fuel feed pump 33 as well as the injection pump 5. By means of this crankcase pressure, the fuel is injected via the injection line 10 and the injection valve 14 into the combustion chamber or into the intake channel. The exhaust gases of a combustion are directed out of the cylinder via the exhaust 17.

It is understood that the foregoing description is that of the preferred embodiments of the invention and that various changes and modifications may be made thereto without departing from the spirit and scope of the invention as defined in the appended claims.

What is claimed is:

1. A handheld portable tool comprising:

a handle housing for holding and guiding the tool;

a two-stroke engine having an air intake pipe for conducting combustion air into the engine;

said engine having a cylinder and a piston movable relative to said cylinder; said engine including a crankcase wherein a crankcase pressure is generated in response to the movement of said piston;

vibration damping means interposed between said engine and said housing to reduce the vibrations transmitted from the engine to the housing;

a pneumatically-driven fuel-injection pump for pumping fuel for said engine, said pump being mounted on said housing so as to be separated from said engine by said vibration damping means;

yieldable connection means for interconnecting said pump and said engine; and, said yieldable connection means including a flexible line for conducting said crankcase pressure to said fuel-injection pump and, a flexible injection line interconnecting said fuel-injection pump and said engine.

2. The portable tool of claim 1, said fuel-injection pump having a pump housing and an air-intake channel of which a segment thereof is formed in said pump housing.

3. The portable tool of claim 2, said pump housing having a pump chamber for receiving fuel to be injected into said engine; said segment of said air-intake channel being disposed next to said pump chamber so as to permit the latter to be cooled by the intake air flowing through the air-intake channel.

4. A handheld portable tool comprising:

a handle housing for holding and guiding the tool;

a two-stroke engine having an air intake pipe for conducting combustion air into the engine;

vibration damping means interposed between said engine and said housing to reduce the vibrations transmitted from the engine to the housing;

a pneumatically-driven fuel-injection pump for pumping fuel for said engine, said pump being mounted on said housing so as to be separated from said engine by said vibration damping means;

yieldable connection means for interconnecting said pump and said engine;

said fuel-injection pump having a pump housing and an air-intake channel of which a segment thereof is formed in said pump housing;

said pump housing having a pump chamber for receiving fuel to be injected into said engine;

said segment of said air-intake channel being disposed next to said pump chamber so as to permit the latter to be cooled by the intake air flowing through the air-intake channel;

said segment of said air-intake channel being a throttle-flap support; and, said fuel-injection pump including a throttle flap rotatably journalled in said support.

5. A handheld portable tool comprising:

a handle housing for holding and guiding the tool;

a two-stroke engine having an air intake pipe for conducting combustion air into the engine;

vibration damping means interposed between said engine and said housing to reduce the vibrations transmitted from the engine to the housing;

a pneumatically-driven fuel-injection pump for pumping fuel for said engine, said pump being mounted on said housing so as to be separated from said engine by said vibration damping means;

yieldable connection means for interconnecting said pump and said engine;

said fuel-injection pump having a pump housing and an air-intake channel of which a segment thereof is formed in said pump housing; and, said fuel-injection pump including a pneumatically-driven fuel feed pump integrated into said pump housing.

6. The portable tool of claim 1, comprising a fuel tank mounted in said handle housing; and, said injection pump being mounted near said fuel tank.

7. The portable tool of claim 1, said handle housing including a rearward handle; and, said fuel-injection pump being mounted adjacent said rearward handle.

8. The portable tool of claim 1, said injection line being made of form stiff, soft, temperature resistant plastic having a polyamide base.

9. The portable tool of claim 4, said yieldable connection means comprising an air intake conduit interconnecting said engine and said segment of the air intake channel.

* * * * *